US005230943A

United States Patent [19]

Pregont

[11] Patent Number: 5,230,943

[45] Date of Patent: Jul. 27, 1993

[54] FREE-FLOWING DUNNAGE OF MOLDED PULP

[75] Inventor: Jack E. Pregont, Janesville, Wis.

[73] Assignee: Pulptech Corporation, Janesville, Wis.

[21] Appl. No.: 800,281

[22] Filed: Nov. 29, 1991

[51] Int. Cl.[5] ..... B32B 3/00

[52] U.S. Cl. ..... 428/156; 206/523; 206/584; 428/174; 428/178; 428/192; 428/402; 428/537.1; 428/537.5; 428/903.3; 428/170; 493/967

[58] Field of Search ..... 428/64, 537.1, 402, 428/174, 170, 171, 34.2, 156, 178, 537.5, 903.3, 192; 206/584, 523; 493/967

[56] References Cited

U.S. PATENT DOCUMENTS

| | | | |
|---|---|---|---|
| 1,284,928 | 11/1918 | Raymond | 162/410 |
| 1,527,201 | 2/1925 | Louisot | 162/228 |
| 1,661,727 | 3/1928 | Koppelman et al. | 162/116 |
| 1,701,238 | 2/1929 | Kennedy | 162/230 |
| 1,859,325 | 5/1932 | Ayerst | 162/230 |
| 1,899,197 | 2/1933 | Huff et al. | 162/230 |
| 1,907,795 | 5/1933 | Hall | 162/230 |
| 2,182,274 | 12/1939 | Baker et al. | 162/230 |
| 2,571,334 | 10/1951 | Browne | 493/967 |
| 2,649,958 | 8/1953 | Rausch | 206/584 |
| 2,663,230 | 12/1953 | Wagner | 162/410 |
| 2,703,041 | 3/1955 | Comstock | 162/410 |
| 2,955,975 | 10/1960 | Richardson | 162/199 |
| 3,185,370 | 5/1965 | Reifers et al. | 229/2.5 |
| 3,306,813 | 2/1967 | Reifers | 162/223 |
| 3,320,120 | 5/1967 | Randall | 162/391 |
| 3,606,726 | 9/1971 | Spertus et al. | 53/28 |
| 3,613,522 | 10/1971 | Johnson et al. | 93/1 WZ |
| 3,650,877 | 3/1972 | Johnson | 161/47 |
| 3,661,707 | 5/1972 | Emery et al. | 162/392 |
| 3,723,240 | 3/1973 | Skochdopole et al. | 161/173 |
| 3,855,053 | 12/1974 | Fuss | 161/168 |
| 3,929,564 | 12/1975 | Reifers | 162/224 |
| 3,933,959 | 1/1976 | Skochdopole et al. | 264/45.5 |
| 4,104,440 | 8/1978 | Collins | 206/584 |
| 4,109,040 | 8/1978 | Ottaviano | 428/129 |
| 4,806,410 | 2/1989 | Armington | 428/126 |
| 4,839,210 | 6/1989 | Komaransky | 428/77 |
| 4,937,131 | 6/1990 | Baldacci et al. | 428/131 |
| 4,994,148 | 2/1991 | Shetka | 162/227 |
| 4,997,091 | 3/1991 | McCrea | 206/584 |
| 5,151,312 | 9/1992 | Boeri | 206/584 |

FOREIGN PATENT DOCUMENTS

| | | | |
|---|---|---|---|
| 17932 | 11/1991 | World Int. Prop. O. | 206/584 |

OTHER PUBLICATIONS

Use and Testing of Free-Flowing Cushioning, by Arthur Graham Modern Packaging Magazine, Jul. 1971.

Emery International Developments, Ltd.-Pulp Molding Equipment Brochure.

*Primary Examiner*—Ellis P. Robinson
*Assistant Examiner*—Nasser Ahmad
*Attorney, Agent, or Firm*—Jansson & Shupe, Ltd.

[57] ABSTRACT

Free-flowing dunnage packaging material is made from molded pulp to form non-planar, dish-like shapes, each having a hollowed central void preferably surrounded by beaded edges. The dunnage pieces are preferably manufactured by a free of form process which results in random shaping, thereby avoiding nesting and maintaining package volume.

9 Claims, 3 Drawing Sheets

FREE-FLOWING DUNNAGE OF MOLDED PULP

FIELD OF THE INVENTION

This invention is related generally to material used for packaging purposes, or dunnage, and, more particularly, to free-flowing dunnage material.

BACKGROUND OF THE INVENTION

Interior free-flowing packaging materials, or "dunnage" as they are otherwise known, vary greatly in size and shape. The quality of any dunnage material for packaging purposes is dependent on certain functional characteristics. Among the desirable qualities in any free-flowing dunnage material are structural strength, low density and volume maintenance. Ideally, the material should also be lightweight, easy to use, versatile for use with any packaged product or with any type of container, non-settling, reusable and static-free. Primarily, dunnage material should have the necessary characteristics to prevent movement of the product within the container and to prevent contact between the product's surface and the interior surfaces of the container.

Foamed plastic materials have dominated the packaging and dunnage material markets. Foamed plastic products tend to be lightweight and homogenous across any cross section but tend to have certain disadvantages in handling, such as excessive static problems.

Furthermore, environmental concerns have raised considerable questions regarding the use of foamed plastic as a dunnage material. Plastics are not biodegradable and non-static. There are numerous examples of inventions for free-flowing plastic dunnage. A few examples of these inventions are disclosed in Skochdopole et al., U.S. Pat. No. 3,723,240, Fuss, U.S. Pat. No. 3,855,053 and Skochdopole et al., U.S. Patent No. 3,933,959. Despite the overwhelming use of plastics as the favored material for free-flowing dunnage products, one attempt appears in the prior art to use pulp fiber as dunnage.

McCrea, U.S. Pat. No. 4,997,091, teaches the manufacture of free-flowing pulp dunnage by extruding pieces of paper fiber and allowing them to dry into solid shapes. However, solid pulp is a heavier material than solid foamed plastic, resulting in greater shipping costs. Consequently, despite all of the aforementioned disadvantages in using foamed plastic as a dunnage material, foamed plastic continues to dominate as the favored material used in the manufacture of free-flowing dunnage.

Molded pulp has been previously used to manufacture containers and other form packaging, such as egg cartons and the like. The manufacturing process for form packaging is distinct from the invention. First, waste paper and water is mixed together to produce a pulp slurry. Forming dies are then immersed in the pulp slurry and a vacuum system causes the deposit of pulp fibers on a forming die. A puff of air from the forming die and a vacuum in the transfer die gently cause the wet formed products to lift off of the mold and onto the transfer die. The wet formed products are typically about seventy-five percent water at this stage and pass through a drying oven where hot air is employed to evaporate most of the remaining water content of the product. This process creates products which are hollowed out and uniform in shape and size. This uniformity enables the products to nest on one another.

This nesting tendency of molded pulp products manufactured by the foregoing process is not advantageous for a dunnage material. Nesting of the dunnage could result in a loss of volume maintenance within the shipping container, thereby providing less effective packaging protection.

The prior art recognizes that free form drying of pulp products will result in significant warpage. R.I. Reifers, U.S. Pat. No. 3,185,370. However, this warpage effect is consistently viewed as a substantial disadvantage in product manufacture. The prior art also does not disclose the formation of random beaded edges on the warped product. It furthermore does not teach the manufacture of pulp dunnage by a molding process or the manufacture of molded pulp products without the use of transfer dies.

OBJECTS OF THE INVENTION

It is an object of this invention to provide an inexpensive and light, but effective dunnage material made of molded pulp.

Another object of this invention is to provide a biodegradable dunnage material, which is also non-static Another object of this invention is to provide a dunnage material of molded pulp which will maintain its volume and will not nest.

A further object of this invention is to provide a process for manufacturing dunnage made of molded pulp.

These and other important objects will be apparent from the descriptions of this invention which follow.

SUMMARY OF THE INVENTION

The need for a biodegradable, non-static and lightweight dunnage product is fulfilled by the present invention which is a molded pulp, free-flowing dunnage product that is preferably hollow, rather than solid. The invention is also relatively inexpensive and easy to use. The free-flowing dunnage of this invention overcomes certain well-known disadvantages of plastic materials as well as those of the solid pulp dunnage taught by McCrea.

The invention is based in part on the discovery that warpage of free-formed pulp fibers can be harnessed to advantage rather than disadvantage. This warpage upon drying free of form mounting results in random shaping of each piece, which prevents the individual pieces from nesting on one another. The invention also includes the process for making the product.

Pulp fibers are mixed with water until the mixture becomes a pulp stock slurry. Other materials, such as wax and aluminum sulfate, could also be added to the slurry mixture. If desired, recycled pulp or newsprint could be used by cooking such pulp or newsprint in the presence of heated water for a sufficient time and at a sufficient temperature to reduce the recycled pulp or newsprint to pulp fiber. The pulp stock slurry is then passed through a wire mesh screen. Passing the pulp stock slurry through a wire mesh screen also contemplates passing a fixed screen through the pulp stock slurry. The pulp stock accumulates on the screen mold as it passes through. Such accumulation could be, but would not necessarily have to be, aided by the use of a vacuum system. The screen may incorporate molds of either uniform or non-uniform shape and size which mold the pulp into the desired shape and size. The partially dried pieces are then blown from the screen mold by a blast of air. The pieces are then allowed to dry completely without any form mounting, resulting in a warping of the edges as the pieces close inwardly upon themselves. The pieces further contort as they dry, becoming random, dish-like shapes.

Each individual dunnage piece has a hollowed surface which defines a central void and the edges of each piece define the cross-dimensional lateral space of the void. The edges of each piece are preferably randomly shaped. Additionally, the lateral cross-sections of each piece of dunnage preferably vary randomly in size and shape along the length of each piece.

In another embodiment, with respect to at least one lateral cross-section of each piece of dunnage material, the cross-dimensional space between the edges defining the central void is less than the cross-dimensional space at the widest part of the void. The edges in the foregoing embodiment are preferably beaded along the surface. The free of form drying process in the manufacture of the invention has the tendency to create this beading. If beaded, the edges have greater strength than the hollowed surface of the piece. The dunnage pieces may be derived from recycled pulp or newsprint.

The invention also contemplates the process for the production of the foregoing dunnage material, including the mixing of pulp fibers with water, wax and aluminum sulfate to form a slurry, the collection of damp pulp fibers on a mesh screen mold, the partial drying of the pulp on the screen mold, the blowing of the partially dried pulp from the screen mold and the drying of the pieces free of any form mounting, resulting in the contortion of the pieces into random, dish-like shapes. Another embodiment of this process involves the capture of the fibers on the screen mold by passing it through a wet pulp stock. An alternate embodiment involves the partial drying of the fibers on the screen mold by means of a vacuum. The pieces molded on the screen can be either of uniform or non-uniform size and shape prior to blowing the pulp from the screen.

DETAILED DESCRIPTIONS OF THE PREFERRED EMBODIMENTS

The present invention has the desirable characteristics of structural strength and low density. The product is also readily flowable, so that the dunnage pieces can easily be poured into a container around the object to be protected, filling in the spaces around the object and thereby cushioning the object from the sides of the container during transport or storage.

Figure 1:
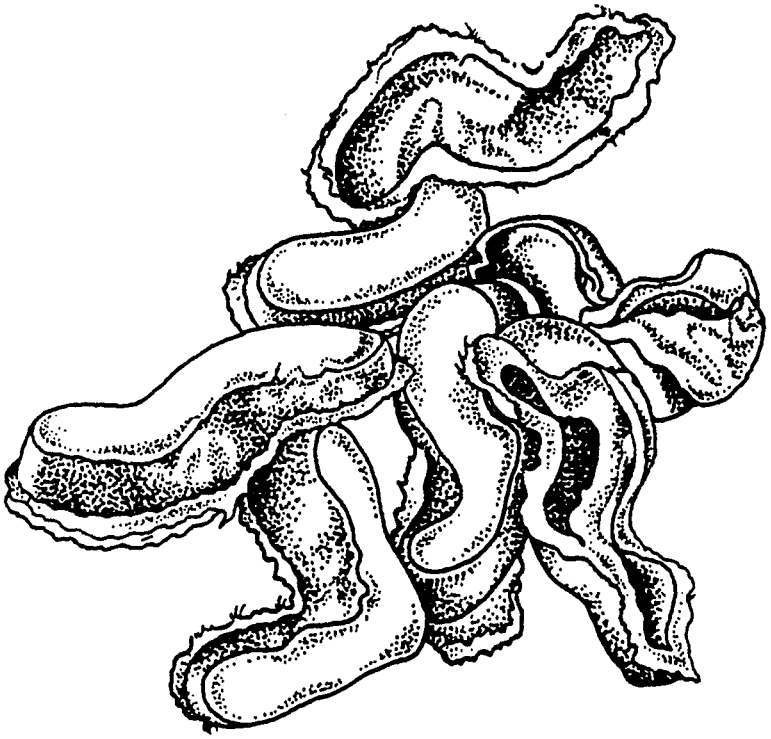
FIG. 1 is a perspective view of several free-flowing dunnage pieces grouped together.
Figure 2:
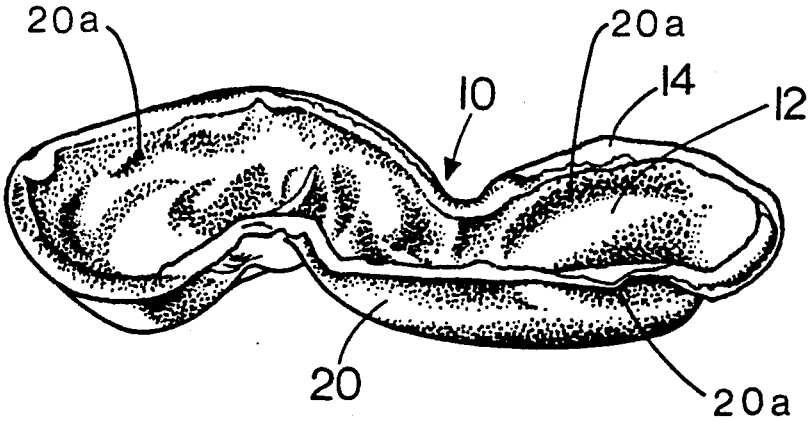
FIG. 2 is an enlarged perspective view of a single piece of molded pulp dunnage.

The preferred embodiment of the invention is a randomly shaped, peanut-sized hollowed piece of molded pulp dunnage, as depicted in FIG. 2. As indicated by FIG. 2, the cross-dimensional shape of each piece varies along the length thereof due to the random shaping of each piece 10 upon drying. Additionally, with respect to at least one lateral cross section of each piece, the cross-dimensional space between the edges defining the central void 12 is less than the cross-dimensional space at the widest part of the void 12, making it impossible for the pieces to nest in one another. This lack of nesting capability results in the maintenance of the necessary volume in the container to provide the desired protection for the packaged item. The beaded edges 14 formed on each piece upon drying lend strength to each dunnage piece to help maintain each respective shape.

Figure 3:
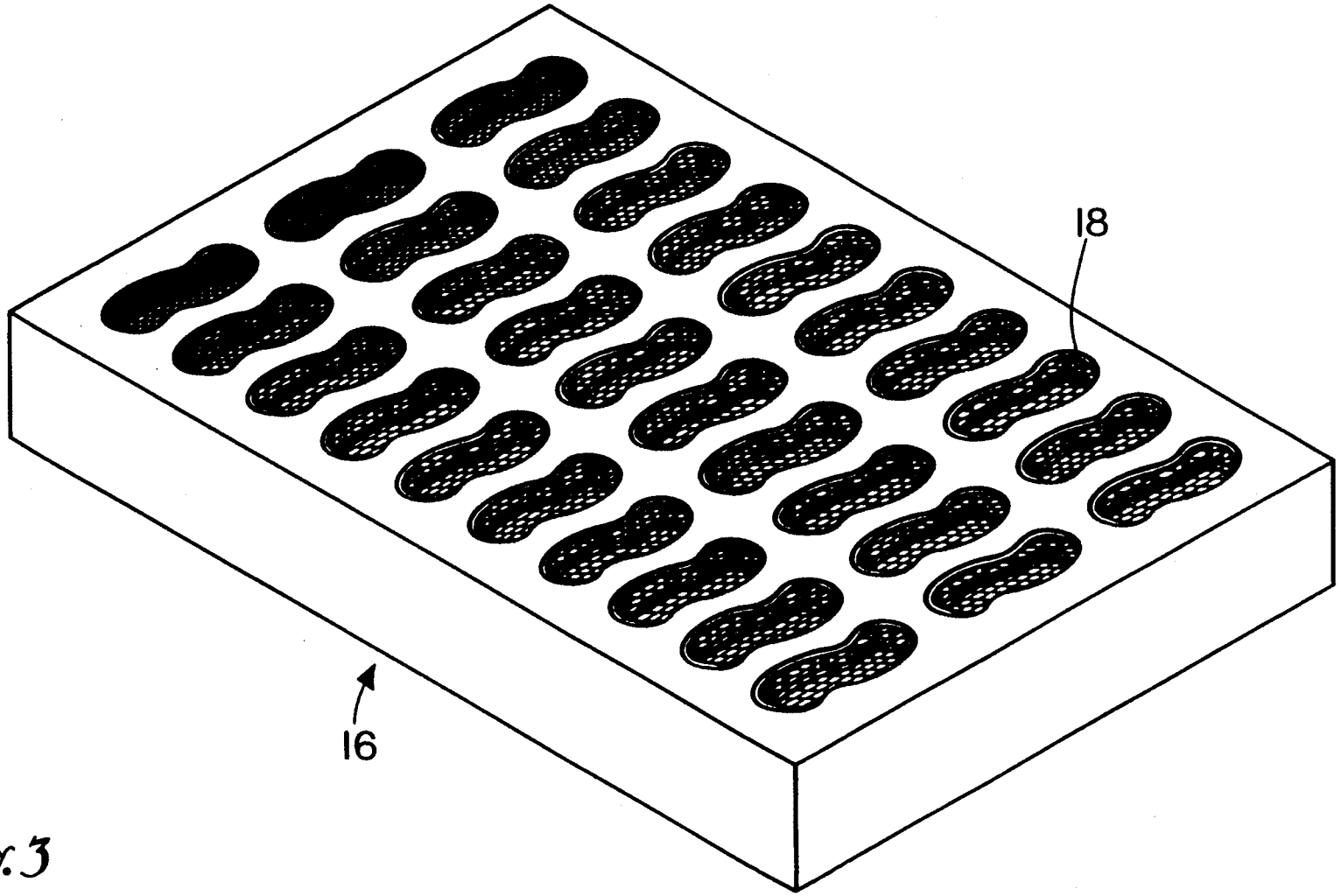
FIG. 3 is a perspective view of the screen mold on which the molded pulp collects to form the initial shapes of the dunnage.
Figure 4:
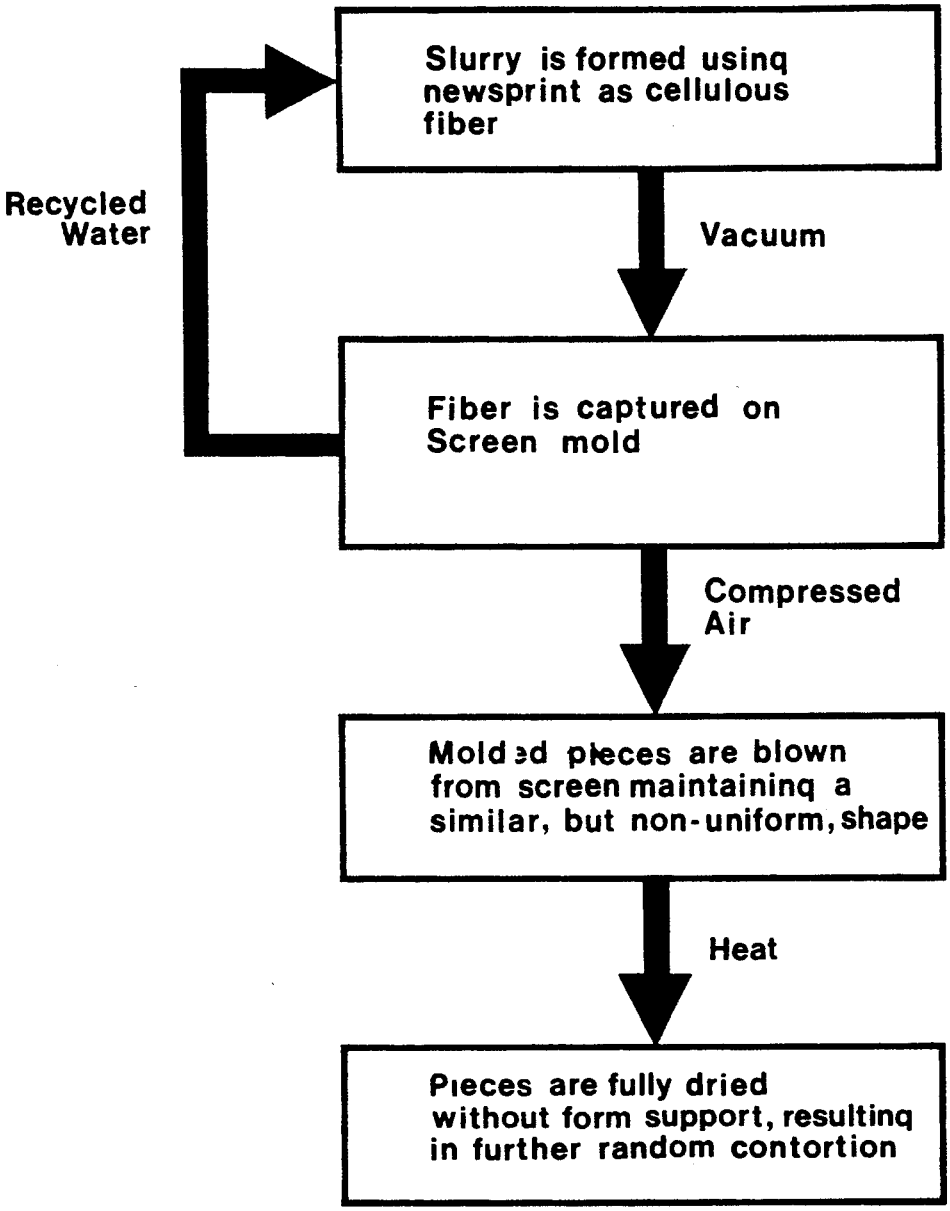
FIG. 4 is a flow chart of the process used to manufacture the molded pulp dunnage.

The preferred embodiment of the invention is manufactured by first mixing pulp fibers with water, wax and aluminum sulfate to form a slurry. One example would involve a mixture of water and pulp to yield a four percent solid consistency. Rosin and wax could then be added to form about two percent of the solid content of the final pulp stock. Formation of pulp slurries is well-known in the industry. It is contemplated that any of the formulas for making pulp slurries could be used in the making of this invention. The slurry is then passed through a mold 16, such as the one depicted in FIG. 3, containing screen openings 18 in uniform, peanut-sized shapes. However, the screen openings 18 could be either uniform or nonuniform and of varying size or shape. The screened openings 18 are recessed, allowing the slurry mixture to collect along the screen surfaces, creating a hollowed surface. In the preferred embodiment, the pulp is partially dried on the screen mold 16 by means of a vacuum. Compressed air is then forced through the screen mold 16 to blow the partially dried dunnage pieces 10 from the mold 16. As the pieces 10 dry freely and without restriction, the edges 14 warp upwardly, resulting in the random contortion of each piece 10 into a nonplanar, dish-like and irregular shape. Each piece 10 upon drying has a hollowed surface 20, including an upstanding surrounding wall **20*a* which terminates in edge 14, defining a central void 12 surrounded by raised edges 14 which are beaded upon drying. Furthermore, upon drying, each piece 10 develops rigidity in shape, although the pulp material is soft enough to provide cushioning. FIG. 4** provides a summary of the major process steps.

While the principles of this invention have been described in connection with specific embodiments, it should be understood that these descriptions are made only by way of example and are not intended to limit the scope of the invention.

What is claimed is:

1. Non-static biodegradable free-flowing and lightweight dunnage packaging material comprising a free-flowing multiplicity of pieces of molded pulp wherein said pieces form non-nestable and non-planar rigid-in-shape dish shapes each having a hollowed surface including an upstanding surrounding wall which terminates in an edge, such hollowed surface defining a central void, the edges and central voids of said pieces being randomly shaped.

2. The dunnage packaging material of claim 1, wherein lateral cross-sections of each of said pieces of molded pulp vary randomly in size and shape along the length thereof.

3. The dunnage material according to claim 1 wherein said material is derived from recycled pulp.

4. The dunnage material according to claim 3 wherein said recycled pulp is newsprint.

5. The dunnage packaging material of claim 1, wherein, on at least one lateral cross-section of each piece of said material, the central void and the edges are such that the space between said edges is less than the cross-dimensional space at the widest part of said central void on such cross-section.

6. The dunnage packaging material of claim 5 wherein said edges are beaded along the surface thereof, thereby lending greater strength to said edges than the hollowed surface thereof.

7. The dunnage material according to claim 5 wherein said material is derived from recycled pulp.

8. The dunnage material according to claim 7 wherein said recycled pulp is newsprint.

9. The dunnage material of claim 5, wherein lateral crosssections of each of said pieces of molded pulp vary randomly in size and shape along the length thereof.

* * * * *